United States Patent [19]

Praeg

[11] Patent Number: 4,559,578

[45] Date of Patent: Dec. 17, 1985

[54] DUAL APERTURE DIPOLE MAGNET WITH SECOND HARMONIC COMPONENT

[75] Inventor: Walter F. Praeg, Palos Park, Ill.

[73] Assignee: The United States of America as represented by the Department of Energy, Washington, D.C.

[21] Appl. No.: 528,278

[22] Filed: Aug. 31, 1983

[51] Int. Cl.[4] ..... H01F 7/20

[52] U.S. Cl. ..... 361/139; 315/5.43; 328/234; 361/160

[58] Field of Search ..... 361/139, 152, 156, 160; 315/5.43; 328/235, 233, 234

[56] References Cited

U.S. PATENT DOCUMENTS 3,811,065 5/1974 Lien ..... 315/5.43

FOREIGN PATENT DOCUMENTS 72670 6/1951 Denmark ..... 328/234

OTHER PUBLICATIONS

"A Double Frequency R.F. System to Increase the D.C.I. Energy", Bergher et al.; IEEE Transactions on Nuclear Science, vol. NS-24, No. 3, 6/77.

*Primary Examiner*—Harry E. Moose, Jr.

*Attorney, Agent, or Firm*—Bruce R. Mansfield; Walter L. Rees; Judson R. Hightower

[57] ABSTRACT

An improved dual aperture dipole electromagnet includes a second-harmonic frequency magnetic guide field winding which surrounds first harmonic frequency magnetic guide field windings associated with each aperture. The second harmonic winding and the first harmonic windings cooperate to produce resultant magnetic waveforms in the apertures which have extended acceleration and shortened reset portions of electromagnet operation.

18 Claims, 4 Drawing Figures

DUAL APERTURE DIPOLE MAGNET WITH SECOND HARMONIC COMPONENT

CONTRACTUAL ORIGIN OF THE INVENTION

The U.S. Government has rights in this invention pursuant to Contract No. W-31-109-ENG-38 between the U.S. Department of Energy and Argonne National Laboratory.

BACKGROUND OF THE INVENTION

This invention pertains to rapid cycling particle accelerators having at least two accelerator rings, and in particular to such accelerators employing dipole electromagnet structures for confining the accelerated particles.

Rapid-cycling particle accelerators have at least one defined particle path, such as a circular ring or "racetrack". Acceleration is typically provided by a plurality of spaced-apart radio frequency resonating cavities which are placed about the ring. Thus, a particular particle or associated group or bunch of particles is accelerated in discrete bursts as it travels around the ring, typically at speeds approaching the speed of light. Particles traveling in the ring are subjected to centripetal forces during particle acceleration. If the particle beam is to be confined within the ring, these centripetal forces must be precisely balanced. The balancing force necessary for particle control is provided by electromagnets located adjacent the several accelerating portions of the ring. The present invention is directed to such electromagnets.

In one type of accelerator, the Rapid Cycling Synchrotron (RCS) located at Argonne National Laboratory, for example, discrete bunches of protons are accelerated for delivery at a designated target. The magnetic confinement of a particular proton bunch must be coordinated with the bunch's injection and ejection from the machine, as well as the duration of residence therein. While protons have been successfully accelerated at pulse repetition rates of 30 pulses per second, economical means of increasing the pulse repetition rate so as to satisfy demands for increasing particle intensity, have been sought.

This invention pertains to the economical design of new machines, and focuses on maximizing the pulse repetition rate that can be obtained from a system of given cost. The tradeoff involved in such designs centers around a balance of radio frequency accelerating voltage and the time rate of increases of the magnetic confinement field. Higher pulse repetition rates require more rapid cycling of the magnetic confinement fields of the machine. The shortening of the confinement field rise time, however, requires costly higher voltage rf accelerator equipment. The present invention is directed to the application of the aforementioned design principles to dual-ring particle accelerator machines.

Basically, dual-ring machines contain two accelerator arrangements which share common electromagnet confinement systems. Examples of a two-ring system employing dipole confinement magnets may be found in an article by R. J. Burke and M. H. Foss entitled "A Rapid Cycling Synchrotron Magnet With Separate AC and DC Circuits", IEEE Transactions on Nuclear Science, Volume NS-26, No. 3, June, 1979.

The arrangement described in the last-mentioned publication comprises several improvements in two-ring accelerators, such as a 75% reduction in tuning capacitance; isolation of ac currents from the dc magnet coils, and dc currents from the ac magnet coils; and coupling of the dc circuit to the ac circuit, while preventing coupling of the ac circuit to the dc circuit. However, this arrangement does not provide an improvement wherein B, the time-rate-of-change of the magnetic guide field, is reduced over conventional designs, with attendant reduction in rf accelerating cost. Improved B performance, as applied to single-ring synchrotron machines, is described in an article by M. Foss and W. F. Praeg, inventor of the present invention, entitled "Shaped Excitation Current for Synchrotron Magnets", IEEE Transactions on Nuclear Science, Volume NS-28, No. 3, June, 1981; and is also described in U.S. patent application Ser. No. 356,652, filed Mar. 9, 1982 in the name of W. F. Praeg. The last-mentioned improvement is provided by additional reactive components which are switched into and out of the magnet coil circuits at precise times, so as to provide a dual-frequency electromagnetic operating cycle. Such switching systems are, however, quite complicated and costly to construct.

It is therefore an object of the present invention to provide an improved electromagnet operating cycle for two-ring rapid-cycling particle accelerators employing dual-aperture dipole confinement/guide magnets, wherein the improvement of the operating cycle includes an extended acceleration period and a shortened reset period.

It is another object of the present invention to provide a dual-aperture dipole circuit having a second harmonic component which reduces the time-rate-of-change of magnetic guide field, thereby reducing the associated particle accelerating system rf power requirements.

Yet another object of the present invention is to provide a dual-aperture dipole magnet system wherein the ring magnets have less magnet iron, and the magnet coils have less copper, compared to conventional designs which utilize separate magnets.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of the instrumentalities and combinations particularly pointed out in the appended claims.

SUMMARY OF THE INVENTION

These and other objects of the present invention are provided by a dual-aperture dipole electromagnet comprising a magnetic core formed of ac lamination material, and a plurality of magnetizing windings of the dc and ac types. Two flux gaps, each for containing a particle accelerator ring are interspersed between three laterally-adjacent coil cavities. The first flux gap, which contains a first accelerating ring, is located between a radially-outer coil cavity and a central coil cavity. The second flux gap, containing a second accelerating ring, is located between a second, radially-inner cavity, and the central coil cavity. Outer and inner first harmonic coils, operating at the fundamental frequency of the electromagnet, surround the first and second flux gaps, respectively.

The windings of the first outer first-harmonic coil are disposed in the radially-outer and central coil cavities, whereas the inner first-harmonic coil windings are disposed in the radially-inner and central coil cavities. The inner and outer first-harmonic coils are arranged so as not to overlap each other in the central coil cavity. A single second-harmonic coil, contained in the inner and outer coil cavities, completely surrounds the inner and outer first-harmonic coils, as well as the first and second apertures. A single dc-coil completely surrounds the second-harmonic coil. The dc and second-harmonic coils couple magnetically to both first-harmonic coils, but the reverse is not true.

The first flux gap, containing the first accelerating ring, has magnetic fluxes of the dc, second-harmonic, and outer first-harmonic coils passing therethrough. These fluxes form a magnetic guide field for accelerated particles which pass through the first ring, with the field directed orthogonal to the ring. The second flux gap, which contains the second accelerating ring, has magnetic fluxes of the dc, second-harmonic, and inner first-harmonic coils passing therethrough, so as to set up a another magnetic guide field which extends orthogonal to the second ring. The first-harmonic magnetic fields of the first and second flux gaps are 180 electrical degrees out of phase with each other, while the second-harmonic fields in these flux gaps are in-phase with each other. The combination of magnetic fields in the first and second flux gaps combine so as to alternately aid and oppose each other within each flux gap, to thereby extend the accelerating periods and shorten the reset periods of electromagnet cycles of operation. The attendant reduction in time-rate-of-change of the magnetic guide fields requires less rf accelerating power, for a given accelerator configuration.

DETAILED DESCRIPTION OF THE PREFERRED EMBODIMENT

Figure 1:
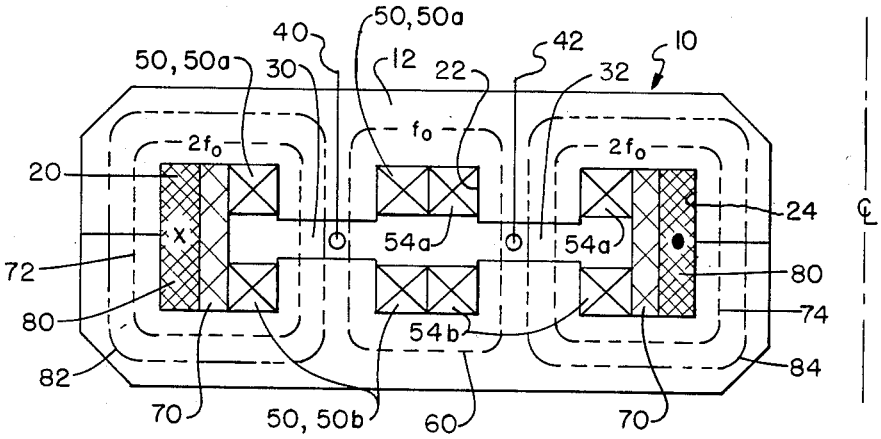
FIG. 1 is a cross-sectional view, in schematic form, of a magnet structure according to the invention.

Referrring now to the drawings, and especially to FIG. 1, a dual-aperture dipole magnet 10 is comprised of a magnet core 12, formed of ac lamination material of the type used in electrical transformers and rotating machinery. This is to be distinguished from prior art arrangements that used a substantial amount of dc magnet material in the magnet core which could not carry the second-harmonic flux because of eddy current shielding. The present invention represents also a simplification over such earlier designs.

A plurality of magnetizing windings enclose separate portions of core 12. Three coil cavities 20, 22, 24, formed in core 12 to receive the magnetizing windings, are herein referred to as the (radially) outer, central, and (radially) inner cavities, respectively. The radially inner/outer orientation arises since, in the preferred embodiment, magnet 10 is part of a circular configuration which accommodates circular particle accelerating rings. An outer flux gap 30, formed between cavities 20, 22 contains a first particle accelerator ring 40. Similarly, an inner flux gap 32, formed between cavities 22, 24, contains a second particle accelerator ring 42. In the preferred embodiment, magnet 10 forms part of a rapid cycling synchrotron for accelerating proton (or the like charged-particle) bunches. Magnet 10 is considered a dual-aperture device in that it contains gaps 30, 32 wherein the two separate charged-particle accelerator rings or "racetracks" 40, 42 are located.

The electromagnetic system of magnet 10 creates the magnetic guide fields necessary to confine the charged-particles traveling in rings 40, 42. Some electromagnet circuits of magnet 10 operate at a fundamental or first-harmonic frequency. In terms of the magnetic operation of magnet 10, varying sine wave magnetic fields of the first-harmonic frequency pass through each ring 40, 42. The overall, or composite magnetic fields of each ring are principally independent of each other, but share some common magnetic characteristics which optimize the overall energy requirements of the rapid-cycling synchrotrons.

In outer ring 40, the first-harmonic field is set up by an outer first-harmonic coil 50. A first portion of the outer first-harmonic coil 50, denoted by the numeral 50*a*, is wrapped around the upper portion of outer gap 30, wherein windings of the first coil portion are disposed in outer coil cavity 20, and central coil cavity 22. The remaining, lower, portion 50*b* of outer first-harmonic coil 50 is wrapped around the lower portion of gap 30, and has windings disposed in lower portions of outer and central cavities 20, 22, respectively.

The inner first-harmonic coil 54 is likewise comprised of upper and lower portions 54*a*, 54*b* which are wound around inner gap 32. The windings of coil portions of 54*a*, 54*b*, are disposed within central and inner coil cavities 22, 24.

Referring to FIG. 1, numeral 60 refers to a flux path of the total first-harmonic (or fundamental frequency), magnetic flux in magnet 10. The flux from outer coil 50 is, for practical purposes, not linked with (i.e. does not surround) outer cavity 20, due to the increased reluctance of this path, compared to path 60 which links central cavity 22 and due also to the effect of coils 70 and 80. That is, any first-harmonic flux of outer coils 50 that would enclose cavity 20 would, by transformer action, induce voltages in coils 70 and 80. These induced voltages would drive currents through coils 70 and 80 which would generate flux that opposes (cancels) the first harmonic flux around cavity 20.

Similarly, inner first-harmonic coil 54 links central cavity 22, rather than inner cavity 24. Coil 50 sets up a magnetic field in outer gap 30, whereas coil 54 sets up a magnetic field in inner gap 32, and the closed loop of path 60 can be considered to comprise two halves, one attributable to coil 50, the other to coil 54.

Figure 2:
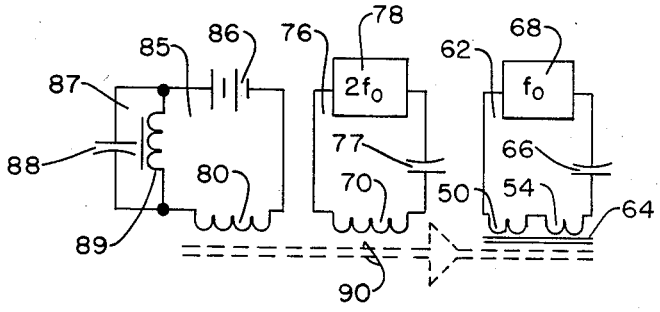
FIG. 2 is an electrical and magnetic schematic diagram of the structure of FIG. 1.

Referring to FIG. 2, the equivalent first-harmonic circuit 62 is shown comprising two $f_O$ (fundamental, or first-harmonic) coils 50, 54 which have their own iron core equivalent magnetic circuit 64, which corresponding approximately to the central one-third portion of magnet 10. Capacitor 66 tunes the first-harmonic circuit to the desired resonant frequency, and the circuit is driven by first-harmonic power source 68. The first-harmonic magnetic flux in gap 30 of closed-loop path 60 is, at any instant, 180 electrical degrees out-of-phase with the first-harmonic magnetic flux in gap 32.

A second-harmonic coil 70, which energizes gaps 30, 32 at twice the frequency of coils 50, 54 (i.e., $2f_0$), is disposed within outer and inner coil cavities 20, 24 so as to encircle first-harmonic coils 50, 54, as well as gaps 30, 32. Magnetic flux set up by coil 70 encircles the outer cavity 20 (as indicated by flux path 72) as well as the inner cavity 24 (as indicated by flux path 74). The second-harmonic flux in gap 30 is at all times in-phase with the second-harmonic flux in gap 32. The equivalent second-harmonic circuit 76 is shown comprising coil 70, tuning capacitor 77, and second-harmonic power source 78.

Referring to FIG. 1, a dc coil 80 is wound within inner and outer coil cavities 20, 24 so as to surround first-harmonic coils 50, 54, as well as second-harmonic coil 70. The magnetic flux paths 82, 84 set up by coil 80 encircle outer and inner coil cavities 20, 24 respectively. As can be seen, coil 80 provides a magnetic bias flux to both gaps 30, 32.

In FIG. 2, the dc circuit 85 is shown comprising coil 80, dc power source 86, and a second-harmonic suppressing filter 87 which comprises a capacitor 88 and an inductor 89 which are tuned to the frequency of the second-harmonic. In FIG. 2, symbol 90 indicates magnetic linkage between circuits 62, 76, and 85, wherein the dc and second-harmonic circuits 76, 85 are coupled to each other and are unidirectionally coupled to the first-harmonic circuit 62 so as to superimpose their waveforms thereupon. However, circuit 62 is not coupled so as to cause a response in circuits 76, 85. Thus, any magnetic influence of the first-harmonic coils 50, 54 is, for practical purposes, magnetically isolated from the dc and second-harmonic circuits 76, 85, such that the waveforms of circuits 50, 54 are not super-imposed on the waveforms of circuits 76, 85.

Figure 3A:
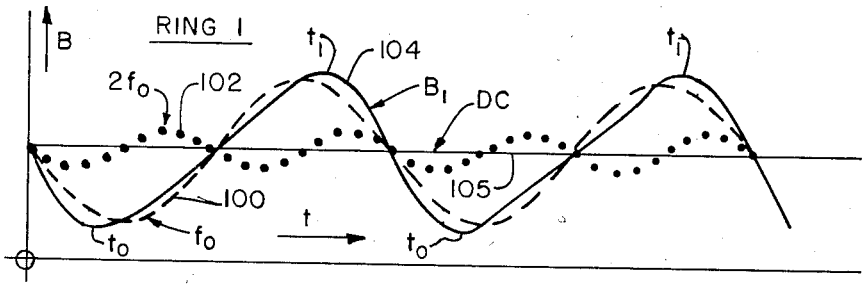
FIGS. 3*a* and 3*b* indicate in graphic form, the magnetic fluxes in the first and second particle accelerator rings, respectively.
Figure 3B:
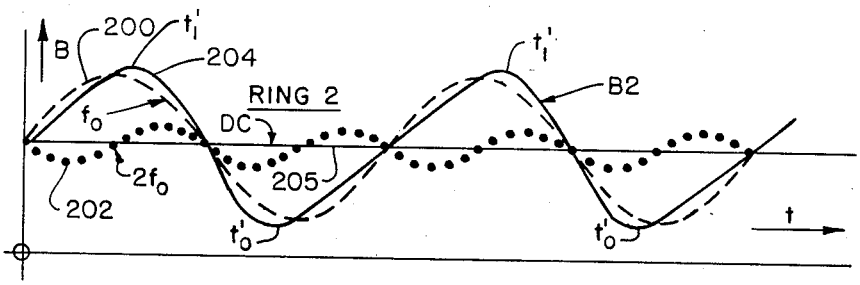

Referring now to FIG. 3, operation of magnet 10 will be explained with reference to the magnetic waveforms of ring 1 (see FIG. 3*a*) and ring 2 (see FIG. 3*b*). In FIG. 3(*a*) waveform 100 represents the magnetic flux in outer flux gap 30 that is set up by coil 50 and first-harmonic power supply circuit 62. Curve 100 is therefore a sine-wave of the fundamental frequency, $f_O$. Curve 102 is a waveform of the magnetic flux set up by coil 70 and second-harmonic circuit 76. It can be seen that waveform 102 is in-phase with waveform 100 but operates at twice the frequency thereof. Waveform 104 results from the superposition of waveforms 100, 102, and represents the resultant magnetic guide field in gap 30. Waveform 105 is the dc offset magnetic flux, necessary to maintain the magnetic guide field unidirectional.

FIG. 3(*b*) shows the operation of the magnet with respect to inner flux gap 32. Waveform 200 represents the first-harmonic magnetic flux in gap 32 that is set up by coil 54 and first-harmonic power supply circuit 62. Note that the fundamental frequency first-harmonic waveform in gap 32 is 180 electrical degrees out-of-phase with respect to the first-harmonic waveform 100 in outer gap 30. Waveform 202 shows the second-harmonic magnetic flux in gap 32 that is set up by coil 70 and circuit 76. The second-harmonic components of the magnetic flux in gaps 30, 32 are in-phase with each other. Waveform 204 in gap 32 results from the superposition of waveforms 200, 202 and represents the magnetic operating cycle of flux gap 32. The dc waveform 205 provides an offset bias, and is the same as waveform 105 in FIG. 3(*a*).

The operating cycle of gap 30, as shown by waveform 104 of FIG. 3(*a*) has an extended accelerating portion $t_0$–$t_1$ and a shortened reset portion $t_1$–$t_0$, i.e., extended and shortened with respect to the fundamental waveform 100. Gap 32 has a similar operation wherein acceleration of the particle beam in ring 2 occurs between times $t'_0$ and $t'_1$, and the magnetic field in gap 32 is reset between times $t'_1$ and $t'_0$. As explained in U.S. patent application Ser. No. 365,562, the extended acceleration time minimizes the time rate-of-rise of magnet energizing current, which is directly proportional to the time rate-of-rise of the magnetic field B. This results in a significant reduction in rf accelerator voltage. The shortened magnet reset time in a given overall period of electromagnet operation provides a greater number of accelerated particles.

However, the present invention does not require capacitive, frequency-changing components to be switched into and out of the magnet circuit during each cycle of electromagnet operation. This savings results from the unique arrangement of two magnet winding systems in a common magnet core. With two separate rings sharing one power supply, but phased 180 degrees apart from each other, energy is transferred between the ring magnets via a resonant capacitor bank. Thus, one ring magnet acts as a choke for the other ring magnet, and separate choke coils are not required. Further, only one capacitor bank is required.

It will be appreciated by those skilled in the art that the present invention is especially suitable for a synchrotron having combined function magnets. Combined function magnets greatly reduce the total number of magnets, magnet supports, power supplies, interconnections, and other related subsystems, as compared to separate function ring magnets. Of course, savings in initial capital investment, siting costs, and power consumption costs are also made possible by the present invention.

Those skilled in the art will immediately appreciate that the physical position of direct-current and second-harmonic coils can be interchanged without requiring modification of the arrangements described above. For example, such interchange would allow the use of radiation-hardened direct-current conductor arrangements immediately adjacent the particle rings.

It will also be immediately realized that higher-frequency harmonic windings can be added to the arrangements described above, according to the teaching of the present invention. For example, a fourth-harmonic winding can be added to the above arrangement, so as to surround the second-harmonic winding. The driving circuit for the fourth-harmonic winding will contain a filter to trap second-harmonic energy, while the direct current and second-harmonic currents will contain filters to trap fourth-harmonic frequency energies. The direct current, second-harmonic, and fourth-harmonic windings will be unidirectionally coupled to the fundamental frequency winding, as before.

The embodiments of this invention in which an exclusive property or privilege is claimed are defined as follows:

1. In a dual-aperture dipole magnet comprising:

a magnetic core having first and second spaced-apart magnetic flux gaps formed therein, said magnetic core carrying magnetic flux which crosses said first and said second flux gaps, said magnetic core further having first and second end sections and a central section positioned therebetween;

a central, a first end, a second end coil cavity formed in said central, first end, and said second end sections of said core respectively, for receiving a plurality of windings of electric coils which set up a plurality of magnetic fluxes which are carried by said magnetic core and which cross said flux gaps;

a plurality of magnetizing windings disposed in said central, first end, and second end coil cavities;

first-harmonic generating means for energizing said magnetizing windings with a sine wave of a fundamental frequency, so as to set up a magnetic flux of a fundamental frequency in said first and said second flux gaps;

wherein the improvement comprises:

second frequency generating means for energizing said magnetizing windings with a sine wave of twice the fundamental frequency, so as to set up a magnetic flux of a second-harmonic frequency in said first and said second flux gaps;

a direct current generating means for energizing said magnetizing windings so as to set up a unidirectional magnetic flux in said first and said second flux gaps;

phase control means for controlling the electrical phases of said windings of said plurality of magnetizing windings, such that in each of said first and said second flux gaps, at least two different-frequency magnetic fluxes combine so as to form resultant cyclic waveforms having a first cyclic portion of a first frequency and a second cyclic portion of a second higher frequency, said first and said second cyclic portions forming a continuous cycle of electromagnet operation in said first and said second flux gaps, respectively.

2. The arrangement of claim 1 wherein said first-harmonic generating means sets up magnetic fluxes in said first and said second flux gaps which are 180 electrical degrees out-of-phase with respect to each other.

3. The arrangement of claim 2 wherein said first harmonic generating means and said second frequency generating means each generate continuous sequences of magnetic waveform sine waves in said first and said second flux gaps.

4. The arrangement of claim 3 wherein said plurality of magnetizing windings comprise first and a second fundamental frequency windings, a second-harmonic frequency winding, and a direct current winding.

5. The arrangement of claim 4 wherein said second-harmonic winding is disposed about and surrounds said first and said second fundamental frequency windings.

6. The arrangement of claim 5 wherein said direct current winding surrounds said first and said second fundamental frequency windings.

7. The arrangement of claim 6, wherein said direct current winding also surrounds said second-harmonic frequency winding.

8. The arrangement of claim 7 wherein said direct current and said second harmonic frequency windings are magnetically coupled to said first and said second fundametal frequency windings in an unidirectional manner such that said direct current and said second harmonic frequency windings are coupled so as to magnetically superimpose their waveforms on said first and said second fundamental frequency windings, and to remain in magnetic isolation from superposition of the waveforms of said first and said second fundamental frequency windings.

9. The arrangement of claim 7 wherein said resultant magnetic flux in said first and said second flux gaps is unidirectional.

10. The arrangement of claim 9 further including particle accelerating rings disposed in said first and said second flux gaps, respectively.

11. The arrangement of claim 10 wherein said particle accelerating rings are disposed laterally adjacent each other on a common horizontal plane.

12. In a dual-aperture dipole magnet comprising:

an elongated magnet core having a center and first and second ends, a first and a second outer coil cavity located adjacent said first and said second ends, respectively, a third coil cavity located adjacent the center of said magnet core;

first and second flux gaps formed in said magnet core, between said central coil cavity and said first and said second outer coil cavities, respectively;

a first alternating current coil disposed in said first outer and said central coil cavities, and surrounding said first flux gap, so as to set up an alternative magnetic flux of a first harmonic frequency in said first flux gap;

a second alternating current coil disposed in said second and said central coil cavities, and surrounding said second flux gap so as to set up an alternating magnetic flux of said first harmonic frequency in said second flux gap;

a direct current coil disposed in said first and said second outer coil cavities so as to set up a unidirectional magnetic flux in said first and said second flux gaps, said direct current coil positioned so as to surround said first and said second alternating current coils;

wherein the improvement comprises:

a third alternating current coil disposed in said first and said second outer coil cavities so as to be surrounded by said direct current coil and to surround said first and said second alternating current coils, said third alternating current coil being energized so as to set up an alternating current magnetic flux at a second harmonic frequency twice said first harmonic frequency;

means for maintaining the magnet waveforms set up by said first and said second alternating current coils in said first and said second flux gaps, 180 electrical degrees out of phase with respect to each other;

means for maintaining the magnetic waveform set up by said third alternating current coil in phase with at least one of said magnet waveforms set up by said first and said second alternating current coils; and said magnet waveforms of said third alternating current coil combining with the magnet waveforms of said first and said second flux gaps, respectively, so as to form resultant magnet waveforms in said first and said second flux gaps, respectively, said resultant magnet waveforms having an extended accelerating portion, and a shortened reset portion, extended and shortened relative to the waveform set up by said first and said second alternating current coils.

13. The arrangement of claim 12 further comprising a first electrical circuit for energizing said direct current coil, said circuit including a filter for suppressing said second harmonic frequency.

14. The arrangement of claim 13 further comprising a second electrical circuit for energizing said first and said second alternating current coils, comprising a series connection of a first harmonic frequency power source, and a tuning capacitor, said second electrical circuit connected in series with said first and said second alternating current coils.

15. The arrangement of claim 14 further including a third electrical circuit for energizing said third alternating current coil, said third electrical circuit comprising a series connection of an ac power source operating at said second harmonic frequency, and a tuning capacitor, said third electrical circuit connected in series with said third alternating current coil;

said third electrical circuit magnetically coupled to said second electrical circuit so as to superimpose its waveforms upon said second electrical circuit; and means for maintaining said first and said third electrical circuits in magnetic isolation from superposition of the waveforms of said second electrical circuit.

16. The arrangement of claim 15 wherein said first and said second flux gaps include accelerating rings for first and second rapid cycling synchrotron machines, respectively.

17. The arrangement of claim 16, wherein said first and said second alternating current coils generate a continous sequence of sinewave magnetic waveforms in said first and said second flux gaps.

18. The arrangement of claim 17 wherein said magnet waveforms in said first and said second flux gaps each comprise a continuous sequence of one-half periods of sine-waves of different frequencies.

* * * * *